US009630692B2

(12) United States Patent
Hasl et al.

(10) Patent No.: US 9,630,692 B2
(45) Date of Patent: Apr. 25, 2017

(54) STEERABLE TRACTOR-TYPE DRIVE FOR BOATS

(71) Applicant: AB VOLVO PENTA, Göteborg (SE)

(72) Inventors: Emil Hasl, Virginia Beach, VA (US); William Gremminger, Virginia Beach, VA (US)

(73) Assignee: AB VOLVO PENTA, Gothenburg (SE)

( * ) Notice: Subject to any disclaimer, the term of this patent is extended or adjusted under 35 U.S.C. 154(b) by 82 days.

(21) Appl. No.: 14/501,270

(22) Filed: Sep. 30, 2014

(65) Prior Publication Data

US 2016/0090164 A1 Mar. 31, 2016

(51) Int. Cl.

| | |
|---|---|
| ***B63H 5/125*** | (2006.01) |
| ***B63H 5/10*** | (2006.01) |
| *B63H 20/02* | (2006.01) |
| *B63H 20/16* | (2006.01) |

(52) U.S. Cl.

CPC ..... *B63H 5/125* (2013.01); *B63H 5/10* (2013.01); *B63H 20/16* (2013.01); *B63H 2020/025* (2013.01)

(58) Field of Classification Search

CPC ..... B63H 20/16; B63H 20/18; B63H 20/22; B63H 20/12; B63H 2020/006; B63H 20/00

USPC ..... 440/51

See application file for complete search history.

(56) References Cited

U.S. PATENT DOCUMENTS

| | | | | |
|---|---|---|---|---|
| 1,813,552 A | | 7/1931 | Stechauner | |
| 1,910,561 A | | 5/1933 | Pierce | |
| 2,345,689 A | | 4/1944 | Snadecki | |
| 2,372,247 A | | 3/1945 | Billing | |
| 3,765,370 A | | 10/1973 | Shimanckas | |
| 4,297,097 A | | 10/1981 | Kiekhaefer | |
| 4,362,514 A | * | 12/1982 | Blanchard | B63H 20/10 440/61 F |
| 4,698,036 A | | 10/1987 | Brandt | |
| 6,623,320 B1 | | 9/2003 | Hedlund | |
| 6,783,410 B2 | | 8/2004 | Florander et al. | |
| 7,226,327 B2 | | 6/2007 | Hallenstved et al. | |
| 7,614,926 B2 | * | 11/2009 | White | B63H 5/125 440/53 |
| 8,430,701 B2 | | 4/2013 | Jegel et al. | |

FOREIGN PATENT DOCUMENTS

DE 3519599 A1 1/1986

OTHER PUBLICATIONS

Volvo Penta IPS, A New Era in Yacht Power, Jan. 2010, 8 pgs.
Volvo Penta Propeller Guide 2012, 2012, 28 pgs.
Tim Banse, "Volvo Penta's Electronic Vessel Control", Marine Engine Digest "Volvo Penta Engines Electronic Vessel Control", 1 pg. http://www.marineenginedigest.com/profiles/volvo_penta/volvo-penta-engines-evc.htm.

* cited by examiner

*Primary Examiner* — Andrew Polay
(74) *Attorney, Agent, or Firm* — Martin Farrell; Michael Pruden

(57) ABSTRACT

A tractor-type stern drive for a boat includes a drive housing pivotally attached to the stern of the boat about a steering axis. At least one pulling-type propeller is rotatably mounted to a forward end of the gear casing. The at least one propeller is powered by a vertical drive shaft perpendicular to the propeller shaft axis. The steering axis is offset forward of the drive shaft to help minimize steering torque about the steering axis.

18 Claims, 4 Drawing Sheets

STEERABLE TRACTOR-TYPE DRIVE FOR BOATS

TECHNICAL FIELD

This disclosure relates to marine drives. Particularly, this disclosure relates to tractor-type drives, those having forward facing propellers configured to pull a boat through the water.

BACKGROUND

Marine drives may be generally classified as inboard, outboard, or inboard/outboard. In an inboard drive, the engine and transmission (or drive) are mounted in the hull and a propeller shaft extends through the bottom of the hull. In an outboard drive, the propeller drive and engine are generally configured as a unit attached to and located outside the hull. Inboard/outboard drives, also referred to as stern drives, have an engine mounted in the hull connected to a drive unit mounted outside of the hull, typically on the stern.

Marine drive units can be further classified as pushing-type and tractor-type. Pushing-type drives generally rely upon propellers facing rearward relative to the boat and generating propulsive force that pushes the boat through the water. Tractor-type drives generally rely upon one or more forward, bow-facing propellers that produce propulsive force to pull the boat through the water. Tractor-type drives may also be referred to as pulling-type drives.

FIG. 1 shows a prior art tractor-type drive arrangement 1 on a boat 2. This arrangement known commercially as the Volvo Penta IPS system, includes an engine with a two-part drive (two engines and drives are shown in the figure). The engine and an upper drive module are mounted in the hull and a steerable lower drive module, or pod, with tractor propellers, is mounted below the hull. The Volvo Penta IPS is considered an inboard drive.

A similar tractor-type drive is described in U.S. Pat. No. 7,226,327, assigned to AB Volvo Penta. FIG. 2 is reproduced from the '327 patent and shows a schematic illustration functionally equivalent to the tractor-type drive 1 from FIG. 1. A pair of forward facing propellers 20, 21 rotate in opposite directions to pull a boat through the water. The propellers 20, 21 are carried on concentric shafts rotatably mounted to an underwater housing 10. The underwater housing 10 is steerable about a substantially vertical pivot axis that coincides with a vertical drive shaft 14, which transmits power from an engine output shaft 16 to the propellers 20, 21. Rotating the underwater housing 10 about the steering axis through the vertical drive shaft 14 directs the propeller force to steer the boat and allows the underwater housing 10 to act as a rudder.

SUMMARY

An embodiment of this disclosure includes a steerable tractor-type drive for a boat. The drive includes a drive support mountable to a stern of the boat and a gear case (or drive housing) pivotally attached to the drive support about a steering axis. At least one pulling-type propeller is mounted on a propeller shaft extending from a front end of the gear case, the propeller shaft to be rotated by a vertical drive shaft perpendicular to a propeller shaft axis. The steering axis is offset forward of the vertical drive shaft.

Another embodiment of this disclosure includes a drive for a boat. The drive has a gear case with at least one front-facing propeller for pulling the boat through the water. The drive also has a drive support for mounting the gear case to the boat. The gear case pivots relative to drive support about a steering axis to steer the boat. The gear case and the drive support are configured such that the at least one propeller is located forward of the steering axis and a center of pressure generated by water rushing past the gear case during a turn is located rearward of the steering axis.

Another embodiment of this disclosure includes a boat. The boat has a hull, thereby having a bow and a stern. The boat includes at least one pulling-type propeller forwardly mounted to a gear case. A drive support steerably mounts the gear case to the stern of the boat. The gear case rotates about a steering axis positioned such that a center of pressure generated by water rushing past the gear case during a turn is located rearward of the steering axis.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

BRIEF DESCRIPTION OF THE DRAWINGS

The features and advantages of the present invention are well understood by reading the following detailed description in conjunction with the drawings in which like numerals indicated similar elements and in which.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

As used herein, the terms "front" and "forward" are defined based on the drives as mounted to the boat with respect to a bow to stern direction of the boat. Likewise, the terms "back", "rear", "rearward", and "aft" are also defined based on the drive as mounted to the boat with respect to a bow-stern direction of the boat.

Applicants have determined that in some situations, significant steering loads can be caused by the high transverse loading from forward facing propellers. These steering loads can be felt by the operator through the steering wheel and may present a challenge to some operators. Such steering loads may be more pronounced during steering maneuvers, particularly at high speeds. The propeller forces from forward facing propellers cause a torque about the steering axis during steering. The steering forces may be caused by the increased lift of the propeller blades that rotate into the water flow, combined with the decreased lift of the propeller blades that move with the water flow. These steering forces can occur in either direction as the gear case is pivoted. The resulting torque biases the propellers and the gear case to attempt to continue to rotate in the direction of steering.

Figure 3:
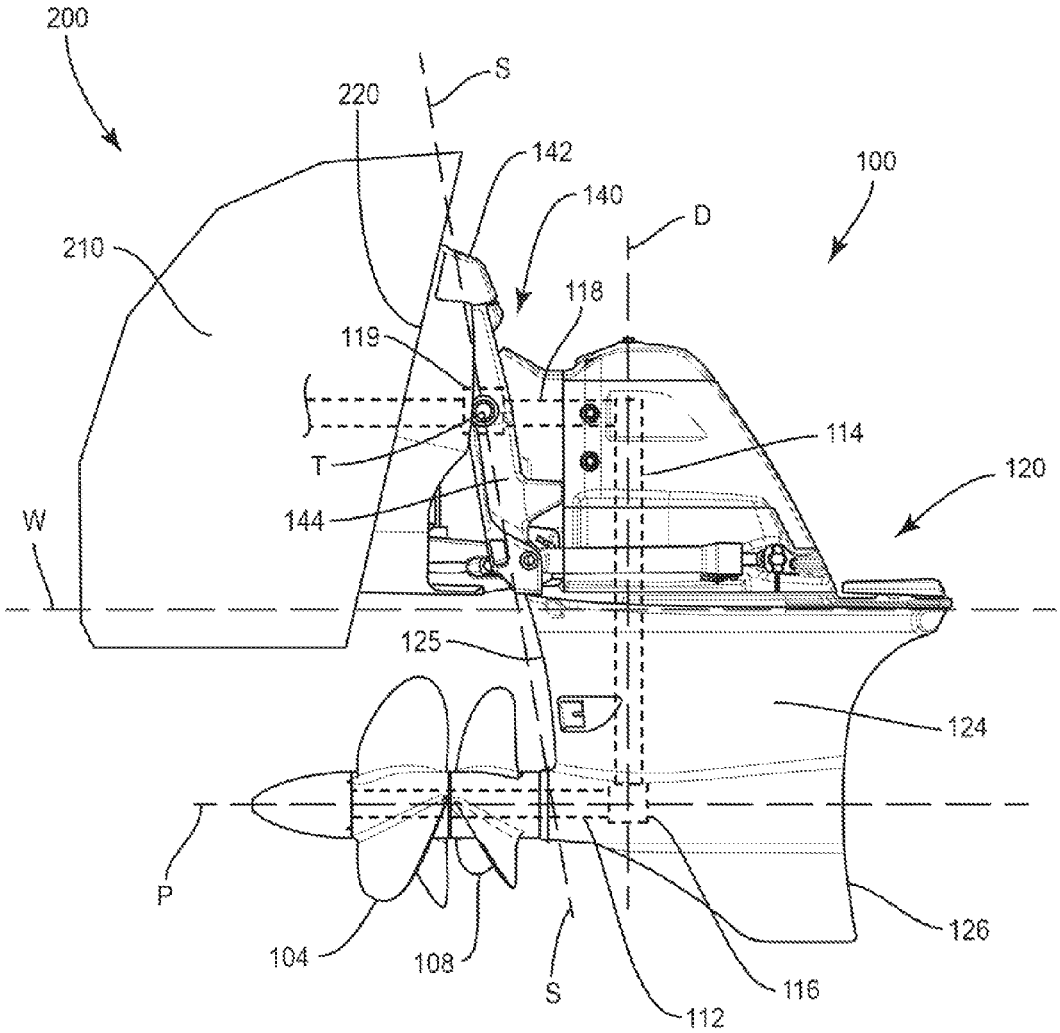
FIG. 3 shows a tractor-type drive according to embodiments of the present disclosure.

FIG. 3 shows a drive 100 that is a tractor-type propulsion system for a boat 200. A tractor-type system has been shown to have several benefits over the more common push-type systems that lead to improved range, higher speeds, reduced fuel consumption and lower emissions. Particularly, the tractor-type drives place the forward facing propellers in less disturbed water, which increases the ability of the propellers to convey energy to the water and propel the boat. Placing the propellers further under the boat allows them to be more likely to remain submerged under the water when the drive unit is trimmed, allowing for higher trim angles at slow speeds. Positioning the propellers forward of the drive housing reduces exposure of swimmers at the rear of the boat. Use of the tractor-type drives also allows the exhaust to be directed into the propeller wash, flushing the exhaust further rearward of the boat.

The drive 100 is configured to have improved steering by reducing the net torque around its steering axis. The drive 100 is configured to be mounted to the stern 210 of the boat 200, and to pull the boat 200 through the water. In order to pull the boat 200 through the water, the drive 100 can include a dual propeller arrangement, including a forward propeller 104 and a rearward propeller 108, each of which is considered front-facing, i.e. mounting to a front end of a drive housing 120. The forward and rearward propellers 104, 108 can be driven by a pair of propeller shafts 112 that are coaxial and counter-rotating. The propeller shafts 112 are housed within and extend from the front end of the gear case 120. The propeller shafts 112 coincide with a propeller shaft axis P shown in FIG. 3.

Figure 1:
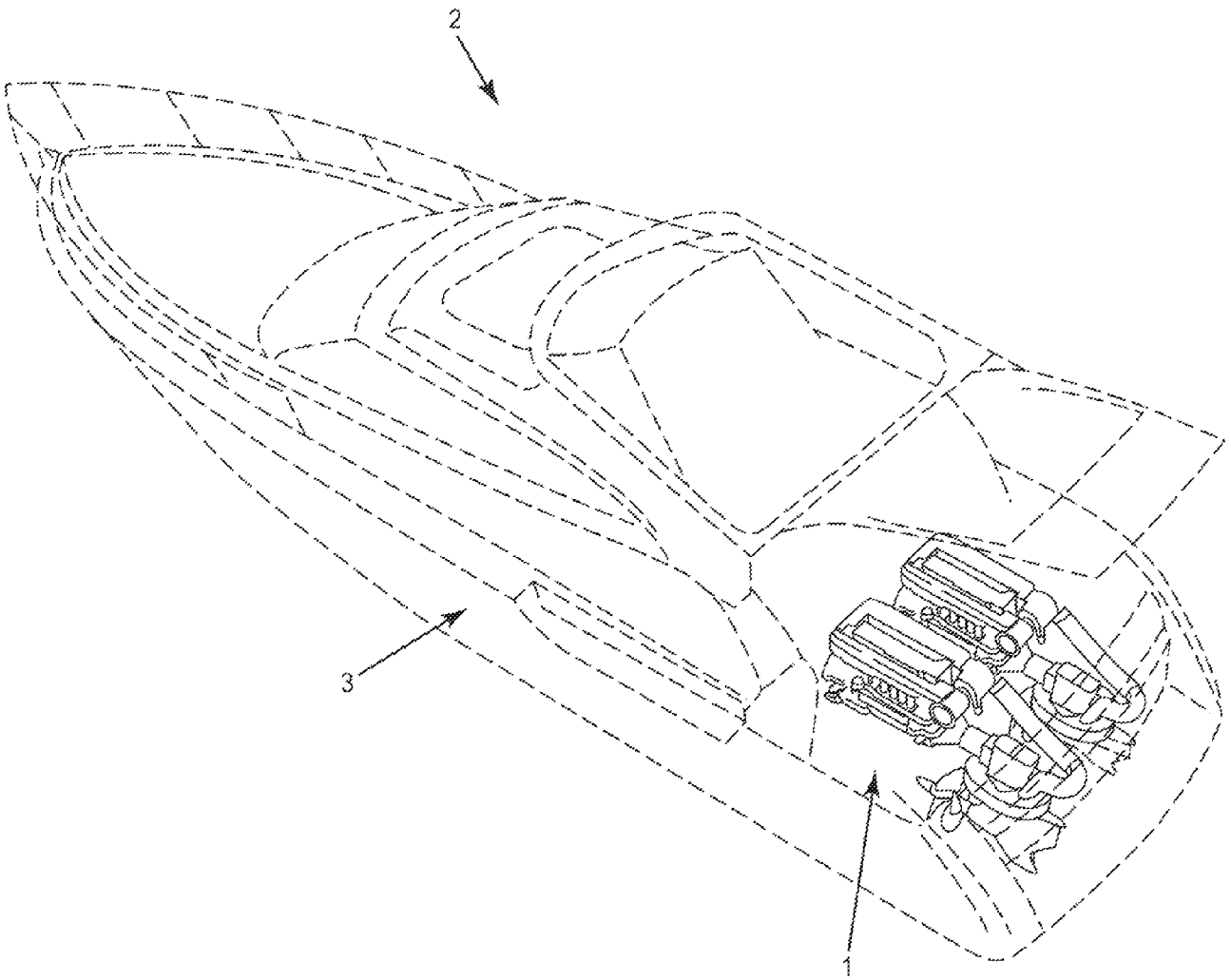
FIG. 1 PRIOR ART
FIG. 1 shows a boat including a prior art tractor-type drive.
Figure 2:
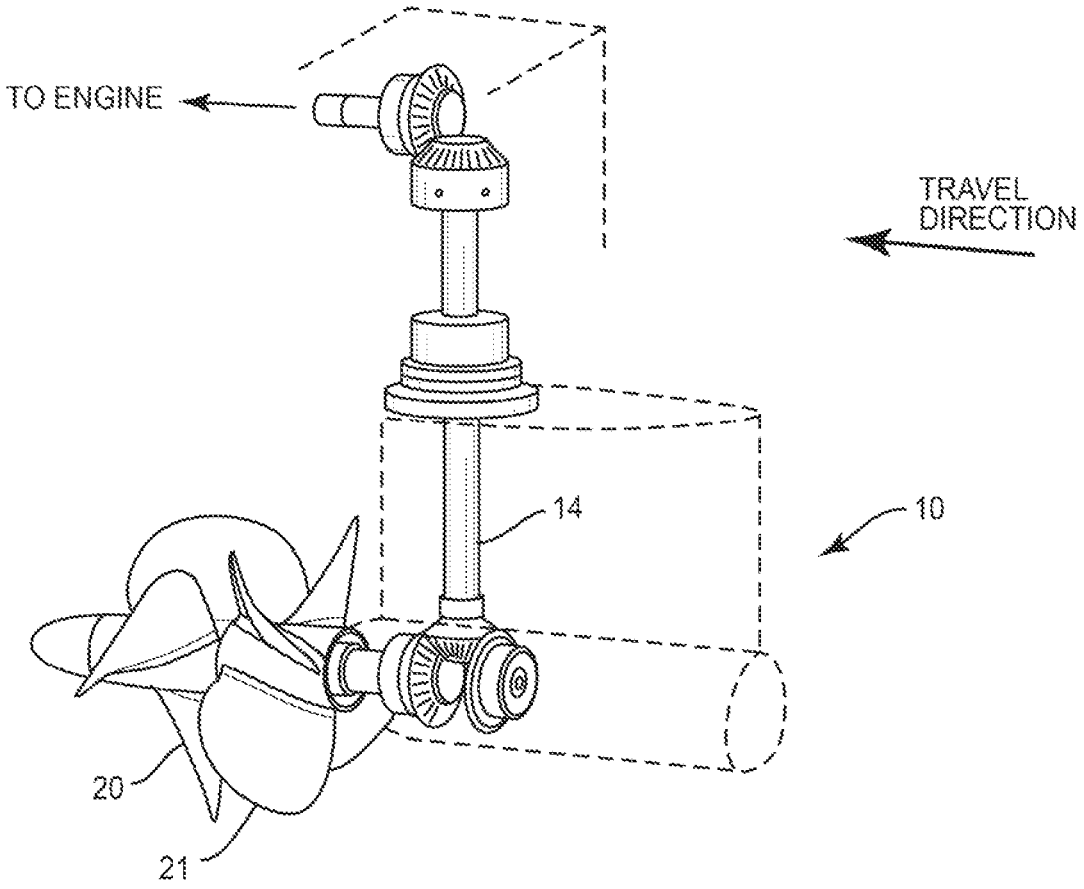
FIG. 2 PRIOR ART
FIG. 2 shows a schematic view of a prior art tractor-type drive.

Similar to the prior art shown in FIG. 2, the propeller shafts 112 are driven by a vertical drive shaft 114 positioned substantially perpendicular to the propeller shafts 112, and along drive shaft axis D. A gear arrangement 116 may operatively connect the propeller shafts 112 with the drive shaft 114. Drive shaft axis D is substantially vertical with respect to the waterline when the boat 200 is still. The drive shaft 114 may be rotated by an input shaft 118 which is coupled to receive drive torque from an engine (not illustrated) housed within the boat 200. The input shaft 118 includes a universal joint 119 to accommodate steering and tilting movements of the drive housing.

The drive 100 further includes a drive support 140 for mounting the drive housing 120 to the stern 210 of the boat 200, particularly the boat's transom 220. The drive support 140 allows the drive housing 120 to pivot relative to the boat 200 about a substantially vertical steering axis S and about a substantially horizontal tilt/trim axis T. The drive support 140 may include a transom shield 142 fixed to the transom 220 and a gimbal ring 144 pivotally mounted to the transom shield. In the embodiment shown, the gimbal ring 144 pivots relative to the transom shield on the steering axis S and the drive housing 120 pivots relative to the gimbal ring on the tilt/trim axis T, although other arrangements are possible. The universal joint 119 is positioned at the intersection of the steering axis S and the tilt/trim axis T. By pivoting the drive housing 120 on the steering axis S, the drive 100 is able to direct the propulsive force of the propellers to steer the boat 200. An underwater portion 124 of the gear case 120 acts as a rudder to deflect water flowing past the underwater portion 124.

The connection between the drive support 140 and the drive housing 120 defines a steering axis S about which the drive housing 120 pivots. The drive housing 120 may be selectively pivoted about the steering axis S in response to operator input by mechanical, hydraulic, pneumatic or other actuation means known in the art. Unlike prior steerable tractor-type drives, the drive 100 of this disclosure has its steering axis S offset from the vertical drive shaft axis D. Therefore, the steering axis S and the drive shaft axis D are not coaxial. In the illustrated embodiment, the steering axis S is moved forward, or ahead of the drive shaft axis D. Both the steering axis S and the drive shaft axis D may be generally considered as lying in a plane (see X-X in FIG. 4) normal to the surface of the water W and containing the propeller axis P. In the embodiment of FIG. 3, the steering axis S is not parallel to the drive shaft axis D. Therefore the steering axis S and the drive shaft axis D will intersect at some point. However, the steering axis S should be considered offset forward of the drive shaft axis D if the steering axis S intersects the propeller axis P at a location ahead of where the drive shaft axis D intersects the propeller axis P. In some embodiments, the steering axis S is angled with respect to the drive shaft axis D so that they intersect at a location below the surface of the water W. In some other embodiments, the steering axis S is angled with respect to the drive shaft axis D to intersect at a location below the drive housing 120. Among other advantages discussed below, removing the steering function from along the drive shaft axis D allows for a smaller packaging size of the drive housing 120, particularly the underwater portion 124.

Figure 4:
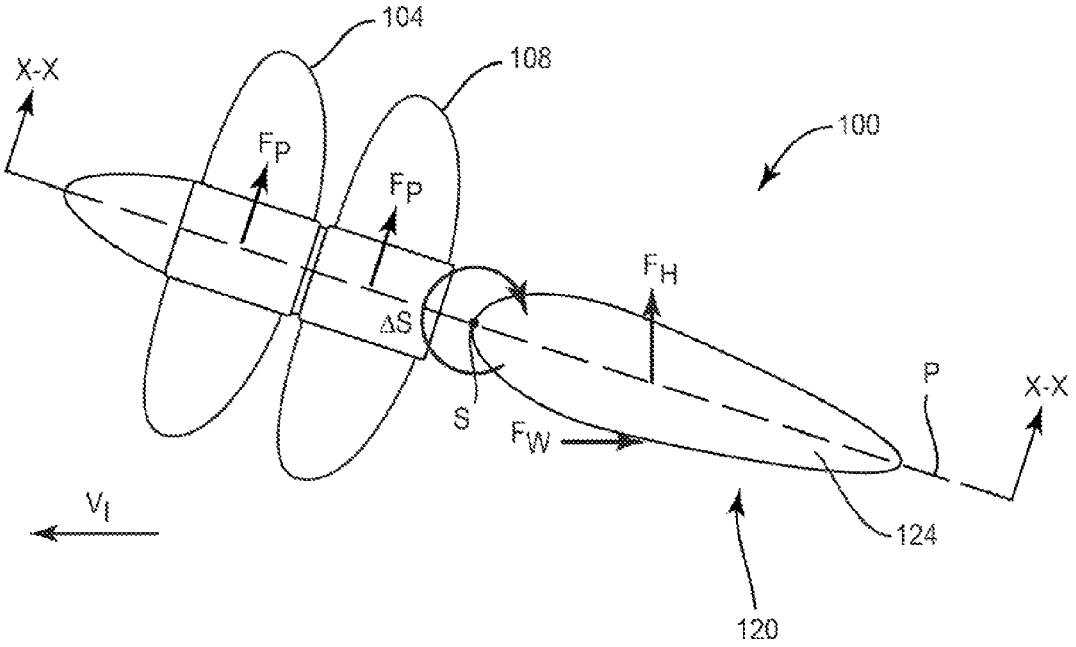
FIG. 4 shows a schematic force diagram according to embodiments of the present disclosure.

More specifically, displacing the steering axis S in a forward direction relative to the drive shaft axis D provides a dual set of advantages resulting in steering force reduction. First, moving the steering axis S forward, closer to the planes of rotation of the forward and rearward propellers 104, 108 reduces the steering torque about the steering axis S by decreasing the moment arm of each propeller force FP (see FIG. 4). Second, shifting the steering axis S alters the relative position of the center of pressure applied to the underwater portion 124 of the drive housing 120 by water flowing on the drive housing 120 during a steering maneuver. The center of pressure is the point where the total sum of a pressure field may be considered to act on a body, in this case, the point where the net force of the water flow acts on the underwater portion 124. As seen in FIG. 4, the drive housing 120, particularly the underwater portion 124, is mostly rearward of the steering axis S, and is preferably almost entirely rearward of the steering axis S. Thus, the center of pressure of the water flow upon the drive housing 120 will necessarily be rearward of the steering axis S and opposite from the propeller force FP relative to the steering axis S.

The underwater portion 124 has a leading edge 125 and a trailing edge 126, as seen in the side view of FIG. 3. At least a portion of the leading edge 125 is both forward of the drive shaft axis D and rearward of the steering axis S. Preferably, a majority of the leading edge 125 is rearward of the steering axis S. In some embodiments, the trailing edge 126 is entirely rearward of the steering axis S.

Mitigation of net steering torque can be better understood, with reference to the force diagram of FIG. 4, particularly with respect to the center of pressure caused by the water. FIG. 4 represents a drive 100, according to embodiments of this disclosure, during a turn. The boat is initially traveling along the direction $V_I$. To perform a left turn, the drive 100 is rotated about steering axis S in the direction shown by the arrow ΔS. The rotation about steering axis S rotates the forward and rearward propellers 104, 108 to a position initially oblique to the oncoming water. When the propeller axis P is oblique to the oncoming water, the lift experienced by the propellers' blades is inconsistent as each blade rotates around the propeller axis P. During a portion of a revolution, a blade is turning relatively against the oncoming water and during a portion of the revolution the blade is turning relatively with the oncoming water. The inconsistency leads to an imbalance that can cause relatively large net propeller steering forces $F_P$ to be generated for each of the forward and rearward propellers 104, 108 acting in a direction to continue the rotation ΔS about steering axis S.

On the other hand, the underwater portion 124 of the drive housing 120 is rotated into the flow of water rushing past the drive 100 during the turn. The water provides a force $F_W$ upon the underwater portion 124 acting at a pressure center located behind the steering axis S and in a direction substantially opposite to the initial direction $V_I$. The water force $F_W$ results in a housing force $F_H$ located rearward of the steering axis S that provides a torque that opposes the torque of propeller forces $F_P$ around steering axis S. Therefore, the net steering forces on the drive 100 as felt by the operator are reduced as compared to other drives of the steerable tractor-type.

The housing force $F_H$ can be optimized by adjusting the projected surface area of the side profile of the underwater portion 124 of the gear case 120, thereby adjusting the surface area rearward of the steering axis S upon which oncoming water impinges to increase or decrease the magnitude of $F_H$.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents. Features from one embodiment or aspect may be combined with features from any other embodiment or aspect in any appropriate combination. For example, any individual or collective features of method aspects or embodiments may be applied to apparatus, product or component aspects or embodiments and vice versa.

We claim:

1. A steerable tractor-type drive for a boat, comprising:

a drive support mountable to a stern of the boat;

a drive housing pivotally attached to the support about a steering axis, the drive housing having a vertical drive shaft connected to drive a propeller shaft, the propeller shaft extending from a forward end of the drive housing;

at least one pulling propeller mounted to the propeller shaft, wherein the steering axis is offset forward of the vertical drive shaft.

2. The drive of claim 1, wherein the drive housing includes an underwater portion configured to be below the waterline of the boat, wherein the underwater portion is almost entirely rearward of the steering axis.

3. The drive of claim 1, wherein the drive housing includes an underwater portion configured to be below the waterline of the boat, wherein the underwater portion has a leading edge, wherein a majority of the leading edge is rearward of the steering axis.

4. The drive of claim 1, wherein two counter-rotating propellers are mounted on the propeller shaft and wherein the steering axis is rearward of at least a forward propeller at a location where the steering axis intersects a propeller axis.

5. The drive of claim 1, wherein the steering axis is angled with respect to the drive shaft so that the steering axis intersects with a vertical drive shaft axis at a location below the waterline of the boat.

6. The drive of claim 5, wherein the steering axis intersects the vertical drive shaft axis at a location below the drive housing.

7. The drive of claim 1, comprising a pair of coaxial, counter-rotating pulling propellers.

8. A drive for a boat, comprising:

a drive housing with at least one front-facing propeller for pulling the boat through the water; and a drive housing support for mounting the drive housing to the boat, the drive housing including an underwater portion configured to be below the waterline of the boat, wherein the drive housing pivots relative to the drive housing support about a steering axis to steer the boat, wherein the underwater portion is almost entirely rearward of the steering axis, wherein the at least one front-facing propeller is carried by a propeller shaft rotated by a vertical drive shaft substantially perpendicular to a propeller shaft axis, wherein the steering axis intersects a drive shaft axis at a location below the drive housing, and wherein the drive housing and the drive housing support are configured such that a center of pressure applied by water moving past the drive housing during a turn is located rearward of the steering axis.

9. The drive of claim 8, wherein the entire drive housing pivots about the steering axis relative to the drive housing support to steer the boat.

10. The drive of claim 8, wherein the steering axis is at least partially rearward of the at least one front-facing propeller at a location where the steering axis intersects a propeller axis.

11. A boat, comprising:

a hull having a stern;

a drive housing having at least one pulling-type propeller forwardly mounted thereon; and a drive housing support steerably mounting the drive housing to the stern of the boat, wherein, the drive housing rotates relative to the drive housing support about a steering axis, wherein the steering axis is at least partially rearward of the at least one pulling-type propeller at a location where the steering axis intersects a propeller shaft axis, and wherein the steering axis is positioned such that the propeller is located forward of the steering axis and a center of pressure applied by water moving past the drive housing during a turn is located rearward of the steering axis.

12. The boat of claim 11, wherein the drive housing includes an underwater portion configured to be below the waterline of the boat, wherein the underwater portion is almost entirely rearward of the steering axis.

13. The boat of claim 11, wherein the at least one pulling-type propeller is carried on a propeller shaft rotated by a drive shaft perpendicular to the propeller shaft axis, and wherein the steering axis is offset forward of the drive shaft.

14. The boat of claim 11, wherein the steering axis intersects a drive shaft axis at a location below the drive housing.

15. The boat of claim 11, wherein the entire drive housing pivots about the steering axis relative to the drive housing support to steer the boat.

16. The boat of claim 11, further comprising an engine housed within the hull of the boat, and a transmission input shaft extending through a transom of the boat into the gear case to provide a stern drive.

17. A boat, comprising:

a hull having a stern;

a drive housing having at least one pulling-type propeller forwardly mounted thereon, the at least one pulling-type propeller being carried on a propeller shaft rotated by a drive shaft perpendicular to the propeller shaft axis, a drive housing support steerably mounting the drive housing to the stern of the boat, wherein, the drive housing rotates relative to the drive housing support about a steering axis, the steering axis offset forward of the drive shaft, and wherein, the steering axis is positioned such that the propeller is located forward of the steering axis and a center of pressure applied by water moving past the drive housing during a turn is located rearward of the steering axis.

18. A drive for a boat, comprising:

a drive housing with at least one front-facing propeller for pulling the boat through the water; and a drive housing support for mounting the drive housing to the boat, wherein the drive housing pivots relative to the drive housing support about a steering axis to steer the boat, wherein the steering axis is at least partially rearward of the at least one front-facing propeller at a location where the steering axis intersects a propeller axis, and wherein the drive housing and the drive housing support are configured such that a center of pressure applied by water moving past the drive housing during a turn is located rearward of the steering axis.

* * * * *